US010525716B1

(12) United States Patent
Deboard et al.

(10) Patent No.: US 10,525,716 B1
(45) **Date of Patent: *Jan. 7, 2020**

(54) APPARATUS AND METHOD FOR SHARING INFORMATION BETWEEN DIGITAL DISPENSE DEVICES CONNECTED TO A NETWORK

(71) Applicant: FUNAI ELECTRIC CO., LTD, Osaka (JP)

(72) Inventors: Bruce Deboard, Lexington, KY (US); Brian Jones, Lexington, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/267,425

(22) Filed: Feb. 5, 2019

Related U.S. Application Data

(63) Continuation-in-part of application No. 16/124,783, filed on Sep. 7, 2018, now Pat. No. 10,255,014.

(51) Int. Cl.
*B41J 2/175* (2006.01)
*B41J 29/393* (2006.01)

(52) U.S. Cl.
CPC ..... *B41J 2/17546* (2013.01); *B41J 2/17566* (2013.01); *B41J 29/393* (2013.01); *B41J 2002/17569* (2013.01); *B41J 2002/17589* (2013.01)

(58) Field of Classification Search
None
See application file for complete search history.

(56) References Cited

U.S. PATENT DOCUMENTS

| | | | | |
|---|---|---|---|---|
| 9,498,972 | B2 | 11/2016 | Ejiri et al. | |
| 2002/0135624 | A1 | 9/2002 | Naka et al. | |
| 2004/0101320 | A1 | 5/2004 | Haramoto | |
| 2004/0220779 | A1* | 11/2004 | Fukao | G06F 3/1204 702/188 |
| 2007/0097161 | A1* | 5/2007 | Ejiri | B41J 2/17546 347/5 |
| 2009/0295849 | A1* | 12/2009 | Ito | B41J 2/17566 347/7 |
| 2013/0314461 | A1 | 11/2013 | Ejiri et al. | |

* cited by examiner

*Primary Examiner* — Frantz Bataille
(74) *Attorney, Agent, or Firm* — Luedeka Neely Group, PC

(57) ABSTRACT

A system tracks the fluid information in fluid cartridges used in digital dispense devices connected to a network. Each device stores a history of cartridges that have been used in the device. Each cartridge stores a fluid information value and/or an indicator that indicates whether the cartridge has been used before in any device. When a device receives a previously-used cartridge, the device broadcasts a request for information about that cartridge from the other devices. Each device having the matching cartridge identification value in its history reports over the network the latest fluid information value associated with the matching cartridge identification value. The requesting device chooses the most up-to-date response based on the latest value of fluid information. The requesting device then updates its memory using the latest value and begins incrementing the information from that latest information for subsequent fluid dispense jobs performed using the installed cartridge.

9 Claims, 3 Drawing Sheets

| Digital Dispense Device 2 Memory | | |
|---|---|---|
| Cartridge ID Value | Fluid Information Value | Timestamp value |
| 00001 | 12345 | Wed Apr 26 02:16:57 2019 |
| 00002 | 67890 | Tue Apr 25 12:06:37 2019 |
| 00003 | 00010 | Mon Apr 24 10:13:42 2019 |

FIG. 3A

| Digital Dispense Device 3 Memory | | |
|---|---|---|
| Cartridge ID Value | Fluid Information Value | Timestamp value |
| 00001 | 30103 | Fri Apr 28 10:46:26 2019 |
| 00004 | 38460 | Tue Apr 25 12:06:37 2019 |
| 00005 | 31526 | Mon Apr 24 10:13:42 2019 |

FIG. 3B

APPARATUS AND METHOD FOR SHARING INFORMATION BETWEEN DIGITAL DISPENSE DEVICES CONNECTED TO A NETWORK

RELATED APPLICATION

This application is a continuation-in-part of application Ser. No. 16/124,783, filed Sep. 7, 2018, now allowed, which is a continuation of U.S. Pat. No. 10,108,384, which issued Oct. 23, 2018.

FIELD

This invention relates to the field of digital dispense devices and to fluid dispense cartridges for the digital dispense devices. More particularly, this invention relates to a system for advertising cartridge information for digital dispense devices over a network when a fluid dispense cartridge is moved from one digital dispense device to another on the network.

BACKGROUND

Nonvolatile memory in fluid dispense cartridges, such as ink jet printers, is typically very small to keep manufacturing costs down, particularly if the cartridges are disposable. Re-writable nonvolatile memory is more expensive than one-time programmable memory. Because of these constraints, conventional fluid dispense cartridges provide only a course indication of fluid remaining in the cartridges due to a small number of fluid levels encoded in the limited nonvolatile memory of the cartridge. When a fluid dispense cartridge is moved from one digital dispense device to another, it carries only this very coarse fluid level information with it. The fluid dispense device must make an assumption about where the actual fluid level is between the coarse levels that are reported by the nonvolatile memory in the cartridge.

In applications such as automated sample preparation and analysis in the medical field, this is unacceptable because accurate information regarding fluid drop count, fluid volume, fluid type, fluid expiration date, fluid droplet error codes, initial fluid cartridge installation date, and the like is important. The fluid used in a digital dispense device must be precisely controlled when depositing the fluid on glass slides or in wells of well plates for various analytical purposes, such as in medical analysis laboratories. What is needed, therefore, is a way to more precisely keep track of fluid information in fluid dispense cartridge as the cartridge moves from one digital dispense device to another on a network of digital dispense devices.

SUMMARY

The system described herein solves the problem of determining detailed information about fluid dispense cartridges used in digital dispense devices that are all connected to the same network and that can communicate with one another over the network. Each digital dispense devices keeps a history of information about the fluid dispense cartridges that have been used in the digital dispense device. Each fluid dispense cartridge stores in its memory an identification value and/or a status indicator value that indicates whether the cartridge has ever been used before in any digital dispense device.

When a digital dispense device receives a fluid dispense cartridge that has been previously used, the digital dispense devices broadcasts a request on the network that in effect says, "I have a used digital dispense cartridge installed having serial number X. Any digital dispense device that has information about this fluid dispense cartridge, please report to me." Each digital dispense device on the network having the matching fluid dispense cartridge identification information in their history then reports over the network the current values of fluid information associated with the matching fluid dispense cartridge identification value. The requesting digital dispense device chooses the most up-to-date response based the fluid information values or the latest time-stamp, if available. The requesting digital dispense device then updates its memory using the fluid information values from the most up-to-date response and begins incrementing the fluid information values for subsequent fluid dispense jobs performed using the installed fluid dispense cartridge. Based on a known fluid information for a particular fluid dispense cartridge, the digital dispense device can precisely determine the moste relevant fluid information values in the fluid dispense cartridge.

Accordingly, preferred embodiments provide a system and method in which digital dispense devices are not solely dependent on fluid information values carried in the memory of the fluid dispense cartridges to update the fluid information values for the cartridges.

Preferred embodiments also provide a system in which fluid dispensed devices connected to a network work together to determine the most accurate value of fluid information for fluid dispense cartridges installed in the digital dispense devices.

In one aspect, the disclosure provides a method for precisely determining information about a fluid in a removable fluid dispense cartridge that is installed in a digital dispense device that is connected to a network of digital dispense devices. The method includes:

(A) storing a fluid cartridge identification value in a cartridge memory device on the fluid dispense cartridge;

(B) storing the fluid cartridge identification value and a current value of fluid information in a memory of the digital dispense device, the fluid information being selected from the group consisting of fluid drop count, fluid volume, fluid type, fluid expiration date, error history, initial fluid cartridge installation date, a time stamp value, usage data, total usage time, number of slides and well plates processed, number of cleaning cycles, number of cartridge wipes, number of maintenance droplets, and two or more of the foregoing; and (C) providing a processor in the digital dispense device for executing instructions for:

(i) accessing the fluid cartridge identification value and current value of fluid information stored in the memory of the digital dispense device;

(ii) communicating over the network with one or more other digital dispense devices connected to the network;

(iii) receiving fluid cartridge information values from the one or more other digital dispense devices connected to the network, wherein the received fluid cartridge information values are associated with a fluid cartridge identification value that matches the fluid cartridge identification value stored in the memory of the digital dispense device;

(iv) updating the current fluid information value stored in the memory device of the digital dispense device to be equivalent to a latest value of the fluid information values received from the one or more digital dispense devices connected to the network; and (v) as fluid dispensing is being performed by the fluid dispense device, incrementing the current information value stored in the memory of the digital dispense device based on an amount of fluid ejected from the fluid dispense cartridge.

In some embodiments, the method includes storing a status indicator value in the cartridge memory device for indicating a used status or a not-used status of the fluid dispense cartridge prior to installing the cartridge in the digital dispense device.

In other embodiments, the method includes determining a remaining fluid level value for the fluid dispense cartridge based on the fluid drop count value stored in the memory of the digital dispense device.

In still other embodiments, the method includes storing a time stamp value associated with the fluid cartridge identification value in the memory of the digital dispense device. In some embodiments, the method includes accessing the time stamp value in the memory of the digital dispense device to determine the most recent timestamp value; and providing the current value of fluid information to the processor in the digital dispense device based on the most recent timestamp value for storing in the memory of the digital dispense device.

In other aspect, the disclosure provides a digital dispense device attached to a network of digital dispense devices. The digital dispense device includes a network interface for communicating with the network of digital dispense devices; a removable fluid dispense cartridge having a cartridge memory device in which a cartridge identification value is stored; a memory for the digital dispense device for storing the cartridge identification value accessed from the cartridge memory device and a current value of fluid information, the fluid information being selected from fluid drop count, fluid volume, fluid type, fluid expiration date, error history, initial fluid cartridge installation date, a time stamp value, usage data, total usage time, number of slides and well plates processed, number of cleaning cycles, number of cartridge wipes, number of maintenance droplets, and two or more of the foregoing; and a processor that executes instructions for communicating over the network with one or more other digital dispense devices; receiving cartridge identification values and current values of fluid information from the one or more other digital dispense devices connected to the network, wherein the received current values of fluid information are associated with a cartridge identification value that matches the cartridge identification value stored in the memory of the digital dispense device; updating the current value of fluid information stored in the memory of the digital dispense device to be equivalent to a latest value of the fluid information values received from the one or more digital dispense devices connected to the network; and as fluid dispensing is being performed by the digital dispense device, incrementing the current value of fluid information stored in the memory of the digital dispense device based an amount of fluid ejected from the fluid dispense cartridge to provide an updated fluid information value for the fluid dispense cartridge.

In some embodiments, the processor executes instructions to determine a remaining fluid level value for the fluid dispense cartridge based on the fluid drop count value stored in the memory of the digital dispense device.

In other embodiments, the processor executes instructions for storing the updated fluid information value in the memory of the digital dispense device in association with the cartridge identification value for communication the updated fluid information value with one or more other digital dispense devices connected to the network.

In still other embodiments, the processor executes instructions for accessing the time stamp value associated with the cartridge identification value from other digital dispense devices on the network to determine the latest time stamp value for the cartridge identification value.

BRIEF DESCRIPTION OF THE DRAWINGS

Other embodiments of the disclosure will become apparent by reference to the detailed description in conjunction with the figures, wherein elements are not to scale so as to more clearly show the details, wherein like reference numbers indicate like elements throughout the several views, and wherein:

FIGS. 3A and 3B are exemplary tabular representations of fluid information values stored in memory of a digital dispense device in association with the cartridge identification values for two different fluid dispense cartridges.

DETAILED DESCRIPTION

Figure 1:
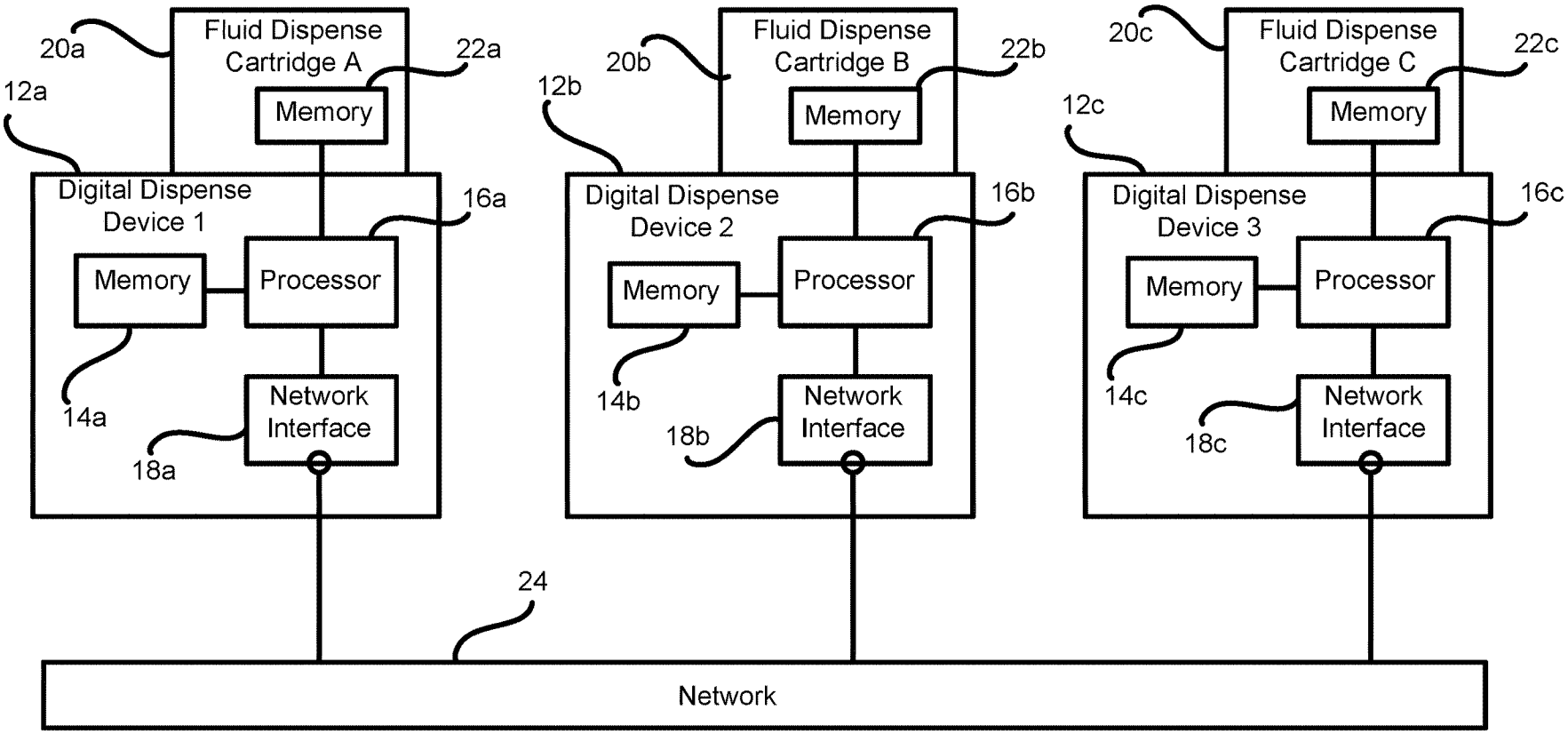
FIG. 1 depicts multiple digital dispense devices connected to a network according to a preferred embodiment.

As shown in FIG. 1, a digital dispense system network 10 includes multiple digital dispense devices 12*a*, 12*b*, 12*c* connected to a network 24, such as an Ethernet network. Each of the digital dispense devices 12*a*, 12*b*, 12*c* includes a rewritable nonvolatile memory 14*a*, 14*b*, 14*c*, a processor 16*a*, 16*b*, 16*c*, and a network interface 18*a*, 18*b*, 18*c*. The network interfaces 18*a*, 18*b*, 18*c* enable communications between each of the digital dispense devices 12*a*, 12*b*, 12*c* via the network 24. Installed in each digital dispense device 12*a*, 12*b*, 12*c* is one or more fluid dispense cartridges such as fluid dispense cartridges 20*a*, 20*b*, 20*c*. Each fluid dispense cartridge 20*a*, 20*b*, 20*c* has a nonvolatile memory 22*a*, 22*b*, 22*c*, and contains a quantity of fluid in an fluid reservoir in the cartridge.

Stored in the nonvolatile memory 22*a*, 22*b*, 22*c* of each fluid dispense cartridge 20*a*, 20*b*, 20*c* is a numerical or alphanumerical cartridge identification value, such as a serial number, that uniquely identifies the fluid dispense cartridge 20*a*, 20*b*, 20*c*. A status indicator may also be stored in each nonvolatile memory 22*a*, 22*b*, 22*c* is a status indicator value that indicates whether or not the fluid dispense cartridge 20*a*, 20*b*, 20*c* has been used before in any other digital dispense device on the network. For example, the status indicator value may be a single-bit value, with a binary 1 indicating a new state and a binary 0 indicating a used state.

In a preferred embodiment, the memory 14*a*, 14*b*, 14*c* of each digital dispense device 12*a*, 12*b*, 12*c* stores cartridge identification values in association with fluid information values and/or timestamp values. The cartridge identification values identify all fluid dispense cartridges that have ever been installed in the digital dispense device 12*a*, 12*b*, 12*c*, as well as a current value of fluid information for the fluid dispense cartridge. The fluid information be selected from fluid drop count, fluid volume, fluid type, fluid expiration date, error history, initial fluid cartridge installation date, a time stamp value, usage data, total usage time, number of slides and well plates processed, number of cleaning cycles, number of cartridge wipes, number of maintenance droplets, and two or more of the foregoing.

The fluid drop count is used to share droplet counting between devices 12*a*, 12*b*, 12*c*, to provide an indication of when the cartridge 20*a*, 20*b*, or 20*c* would be empty and no longer usable. The fluid volume is used to provide the current volume of fluid in a cartridge 20*a*, 20*b*, or 20*c* for use in determining the remaining fluid volume in the cartridge once the fluid drop count is taken into consideration. The fluid type information is used to provide identification of the fluid in the cartridge 20*a*, 20*b*, or 20*c*. The fluid expiration date is used alone or in combination with the initial fluid cartridge installation date to provide information to a user as to when to expire a cartridge based on drop count and fluid evaporation that occurs over time. The error history is used to provide data for a cartridge 20*a*, 20*b*, or 20*c* that would indicate if a cartridge is defective and should be discarded. The timestamp values are used to indicate the most recent date/time that each fluid dispense cartridge 20*a*, 20*b*, or 20*c* was used in in a digital dispense device 12*a*, 12*b*, or 12*c*. The usage data is used to gather statistics on cartridge usage patterns to determine if cartridge maintenance needs to be adjusted for different patterns of usage. The total usage time provides an indication of the amount of time a cartridge has been powered on to determine if the powered on limits for a cartridge are being approached. The number of slides and well plates processed is used to track how many usages are transferred over the network for a particular cartridge 20*a*, 20*b*, 20*c* so that statistics for a particular cartridge may be accumulated and presented to the user. The statistical information may be used to adjust the type or size of cartridge used in the digital dispense device. The number of cleaning cycles is used to provide indication of possible issues with a particular cartridge 20*a*, 20*b*, 20*c*. Too many cleaning cycles may indicate a problem with a particular cartridge 20*a*, 20*b*, 20*c*. Likewise the number of cartridge wipes is used to determine when use of a cartridge should be discontinued. Each time a cartridge is wiped, a minor amount of debris is left on the ejection head of the cartridge. The number of maintenance droplets may be used to provide troubleshooting for a cartridge 20*a*, 20*b*, or 20*c*. An excessive number of maintenance droplets could affect the number of slides and/or well plates a cartridge can be used to process. Sharing the foregoing data for the cartridges 20*a*, 20*b*, 20*c* over the network will provide useful statistics for a user that may be used to improve the cartridges 20*a*, 20*b*, 20*c*, and use thereof for digital dispense devices.

FIGS. 3A and 3B depict exemplary tabular representations of fluid information values, in this case, fluid droplet count values stored in association with the cartridge identification values and/or timestamp values in the memories 14*b* and 14*c* of the fluid dispense devices 12*b* and 12*c*, respectively.

Figure 2:
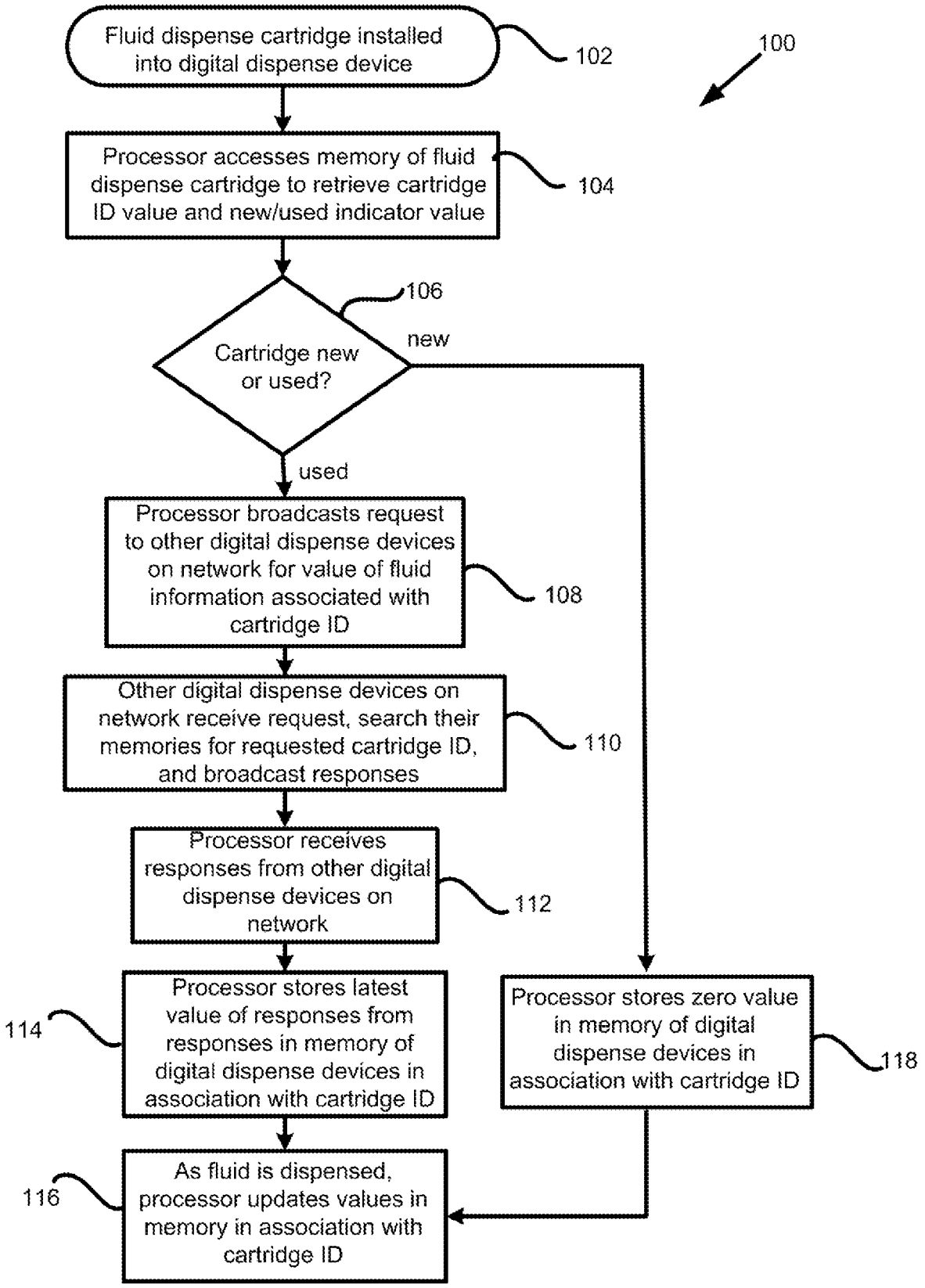
FIG. 2 depicts a method for advertising cartridge identification values and current value of fluid information to digital dispense devices connected to a network according to a preferred embodiment.

FIG. 2 depicts a preferred embodiment of a method 100 for sharing current values of fluid information for fluid dispense cartridges in an digital dispense system network, such as the system 10 depicted in FIG. 1. When a new or used fluid dispense cartridge, such as the cartridge 20*a*, is installed in a digital dispense device, such as the digital dispense device 12*a* (step 102), the processor 16*a* of the digital dispense device accesses the nonvolatile memory 22*a* of the fluid dispense cartridge and retrieves the cartridge identification value and/or the status indicator value (step 104). For example, the cartridge identification value for the cartridge 20*a* may be "00001" and its status indicator value may be "0" indicating that cartridge 20*a* has been used before. Based on determining that the cartridge 20*a* has been used (step 106), the processor 16*a* broadcasts a request through the network interface 18*a* to all other digital dispense devices connected to the network 24 (step 108). The other digital dispense devices 20*b*, 20*c* on the network 24 search their memories 14*b*, 14*c* for a cartridge identification value that matches the value in the request, and each digital dispense device having a matching cartridge identification value in its memory broadcasts a response through its network interface 18*b*, 18*c* to the network 24 (step 110). Each response includes the value of the fluid information that is stored in memory in association with the matching cartridge identification value. For example, if the values depicted in FIG. 3A represent values stored in the memory 14*b* of the digital dispense device 12*b*, the response from digital dispense device 12*b* would include the value of fluid information "12345" associated with the cartridge identification value "00001." Similarly, if the values depicted in FIG. 3B represent values stored in the memory 14*c* of the digital dispense device 12*c*, the response from digital dispense device 12*c* would include the value of fluid information "30103" associated with the cartridge identification value "00001."

The processor of the digital dispense device 12*a* receives the responses from the network 24 (step 112), chooses which response is most relevant, which is the response that includes the latest value of fluid information, and stores the latest value of fluid information in the memory 14*a* in association with the requested cartridge identification value (step 114). For example, the value of fluid information "30103" in the response from digital dispense device 12*c* would be stored in the memory 14*a* because it has a higher value than the value of information "12345" in the response from digital dispense device 12*b*. Thereafter, as fluid is dispensed from the fluid dispense cartridge 20*a* during operation of the digital dispense device 12*a* using the installed fluid dispense cartridge 20*a*, the value of fluid information associated with the cartridge identification value for the fluid dispense cartridge 20*a* is incrementally updated in the memory 14*a*, starting at "30103" (step 116). In alternative embodiments, instead of determining which response includes the latest value of fluid information at step 114, the processor of the digital dispense device 12*a* determines which response includes the most recent timestamp value associated with the reported fluid value information and uses the latest time stamp value to update the fluid value information.

Going back now to step 106, if the status indicator value for the cartridge 20*a* indicates that the installed cartridge 20*a* is new (not used) (step 106), the processor of the digital dispense device 12*a* stores an initial value of information in the memory 14*a* in association with the cartridge identification value (step 118). Thereafter, as fluid is dispensed during operation of the digital dispense device 12*a* using the installed fluid dispense cartridge 20*a*, the value of fluid information associated with the cartridge identification value for the fluid dispense cartridge 20*a* is incrementally updated in the memory 14*a* from an initial value (step 116).

It will be appreciated that the nonvolatile memory 22*a*, 22*b*, 22*c* of each fluid dispense cartridge 20*a*, 20*b* and 20*c* need only store the cartridge identification value rather than fluid information values thereby reducing the need for rewritable nonvolatile memory on each fluid dispense cartridge 20*a*, 20*b*, 20*c*. This also enables the use of smaller nonvolatile memory on each of the fluid dispense cartridges. Accurate fluid information for each fluid dispense cartridge

20*a*, 20*b*, 20*c* is relayed over the network to update the memory 14*a*, 14*b*, 14*c* in each of the fluid dispense devices 12*a*, 12*b*, 12*c* using the fluid dispense cartridges.

The foregoing description of preferred embodiments have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method for precisely determining information about a fluid in a removable fluid dispense cartridge that is installed in a digital dispense device that is connected to a network of digital dispense devices, the method comprising:

storing a fluid cartridge identification value in a cartridge memory device on the fluid dispense cartridge;

storing the fluid cartridge identification value and a current value of fluid information in a memory of the digital dispense device, the fluid information being selected from the group consisting of fluid drop count, fluid volume, fluid type, fluid expiration date, error history, initial fluid cartridge installation date, a time stamp value, usage data, total usage time, number of slides and well plates processed, number of cleaning cycles, number of cartridge wipes, number of maintenance droplets, and two or more of the foregoing; and providing a processor in the digital dispense device for executing instructions for:

accessing the fluid cartridge identification value and current value of fluid information stored in the memory of the digital dispense device;

communicating over the network with one or more other digital dispense devices connected to the network;

receiving fluid cartridge information values from the one or more other digital dispense devices connected to the network, wherein the received fluid cartridge information values are associated with a fluid cartridge identification value that matches the fluid cartridge identification value stored in the memory of the digital dispense device;

updating the current fluid information value stored in the memory device of the digital dispense device to be equivalent to a latest value of the fluid information values received from the one or more digital dispense devices connected to the network; and as fluid dispensing is being performed by the fluid dispense device, incrementing the current information value stored in the memory of the digital dispense device based on an amount of fluid ejected from the fluid dispense cartridge.

2. The method of claim 1, further comprising storing a status indicator value in the cartridge memory device for indicating a used status or a not-used status of the fluid dispense cartridge prior to installing the cartridge in the digital dispense device.

3. The method of claim 1, further comprising determining a remaining fluid level value for the fluid dispense cartridge based on the fluid drop count value stored in the memory of the digital dispense device.

4. The method of claim 1, further comprising storing a time stamp value associated with the fluid cartridge identification value in the memory of the digital dispense device.

5. The method of claim 4, further comprising accessing the time stamp value in the memory of the digital dispense device to determine the most recent timestamp value; and providing the current value of fluid information to the processor in the digital dispense device based on the most recent timestamp value for storing in the memory of the digital dispense device.

6. A digital dispense device attached to a network of digital dispense devices, comprising;

a network interface for communicating with the network of digital dispense devices;

a removable fluid dispense cartridge having a cartridge memory device in which a cartridge identification value is stored;

a memory for the digital dispense device for storing the cartridge identification value accessed from the cartridge memory device and a current value of fluid information, the fluid information being selected from the group consisting of fluid drop count, fluid volume, fluid type, fluid expiration date, error history, initial fluid cartridge installation date, a time stamp value, usage data, total usage time, number of slides and well plates processed, number of cleaning cycles, number of cartridge wipes, number of maintenance droplets, and two or more of the foregoing; and a processor that executes instructions for communicating over the network with one or more other digital dispense devices;

receiving cartridge identification values and current values of fluid information from the one or more other digital dispense devices connected to the network, wherein the received current values of fluid information are associated with a cartridge identification value that matches the cartridge identification value stored in the memory of the digital dispense device;

updating the current value of fluid information stored in the memory of the digital dispense device to be equivalent to a latest value of the fluid information values received from the one or more digital dispense devices connected to the network; and as fluid dispensing is being performed by the digital dispense device, incrementing the current value of fluid information stored in the memory of the digital dispense device based an amount of fluid ejected from the fluid dispense cartridge to provide an updated fluid information value for the fluid dispense cartridge.

7. The digital dispense device of claim 6, wherein the processor executes instructions to determine a remaining fluid level value for the fluid dispense cartridge based on the fluid drop count value stored in the memory of the digital dispense device.

8. The digital dispense device of claim 6, wherein the processor executes instructions for storing the updated fluid information value in the memory of the digital dispense device in association with the cartridge identification value for communication the updated fluid information value with one or more other digital dispense devices connected to the network.

9. The digital dispense device of claim 6, wherein the processor executes instructions for accessing the time stamp value associated with the cartridge identification value from other digital dispense devices on the network to determine the latest time stamp value for the cartridge identification value.

* * * * *